US011534785B2

(12) United States Patent
Seyda

(10) Patent No.: US 11,534,785 B2
(45) Date of Patent: Dec. 27, 2022

(54) DISPENSER FOR DISPENSING FLOWABLE, FOR EXAMPLE LIQUID TO PASTY, COMPOUNDS

(71) Applicant: RPC Bramlage GmbH, Lohne (DE)

(72) Inventor: Ellen Seyda, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 17/428,019

(22) PCT Filed: Feb. 3, 2020

(86) PCT No.: PCT/EP2020/052590
§ 371 (c)(1),
(2) Date: Aug. 3, 2021

(87) PCT Pub. No.: WO2020/161062
PCT Pub. Date: Aug. 13, 2020

(65) Prior Publication Data

US 2022/0118468 A1 Apr. 21, 2022

(30) Foreign Application Priority Data

Feb. 4, 2019 (DE) ..... 10 2019 102 718.7

(51) Int. Cl.
*B05B 11/00* (2006.01)

(52) U.S. Cl.
CPC .... *B05B 11/3008* (2013.01); *B05B 11/00416* (2018.08); *B05B 11/3059* (2013.01); *B05B 11/3067* (2013.01)

(58) Field of Classification Search
CPC ..... B05B 11/3008; B05B 11/00416; B05B 11/3059; B05B 11/3067; B05B 11/3069; B05B 11/3005; B05B 11/306
See application file for complete search history.

(56) References Cited

U.S. PATENT DOCUMENTS 5,363,992 A 11/1994 Meshberg
6,932,244 B2 * 8/2005 Meshberg ..... B65D 83/22 222/548

(Continued)

FOREIGN PATENT DOCUMENTS

DE 94 19 268 U1 1/1995
JP 2004-099061 A 4/2004

(Continued)

OTHER PUBLICATIONS

International Search Report of PCT/EP2020/052590, dated May 27, 2020.

*Primary Examiner* — Vishal Pancholi
(74) *Attorney, Agent, or Firm* — Collard & Roe, P.C.

(57) ABSTRACT

A dispenser for dispensing flowable, for example liquid or pasty, compounds, includes a storage tank for the compound and a pump chamber, and also includes a dispenser head, wherein the dispenser head has a dispensing mouth and the dispenser head can be pressed down against a stop in the direction of a vertical axis of the dispenser to perform a pumping operation, wherein the stop is adjustable in terms of its height. In order to give a dispenser of the kind in question an advantageous design, in particular with regard to handling, the stop is formed by an outwardly exposed sliding track that can be rotated around the vertical axis, against which a projection that protrudes radially outward on the dispenser head comes to a stop when pressing down.

12 Claims, 12 Drawing Sheets

(56) References Cited

U.S. PATENT DOCUMENTS

| | | | | |
|---|---|---|---|---|
| 8,308,029 | B2 * | 11/2012 | Ki | B05B 11/3008 222/321.9 |
| 8,439,230 | B2 * | 5/2013 | Hagen | B05B 11/3001 222/384 |
| 9,789,502 | B2 * | 10/2017 | Maddy | B05B 15/30 |
| 2011/0289890 | A1 | 12/2011 | Floyd et al. | |
| 2018/0153352 | A1 * | 6/2018 | Falcon | B05B 11/02 |

FOREIGN PATENT DOCUMENTS

| | | | |
|---|---|---|---|
| WO | 96/16746 | A1 | 6/1996 |
| WO | 2016/176165 | A1 | 11/2016 |
| WO | 2020/061402 | A1 | 3/2020 |

* cited by examiner

DISPENSER FOR DISPENSING FLOWABLE, FOR EXAMPLE LIQUID TO PASTY, COMPOUNDS

CROSS REFERENCE TO RELATED APPLICATIONS

This application is the National Stage of PCT/EP2020/052590 filed on Feb. 3, 2020, which claims priority under 35 U.S.C. § 119 of German Application No. 10 2019 102 718.7 filed on Feb. 4, 2019, the disclosure of which is incorporated by reference. The international application under PCT article 21(2) was not published in English.

AREA OF TECHNOLOGY

The invention relates to a dispenser for dispensing flowable, for example liquid or pasty, compounds, with a storage tank for the compound and a pump chamber, further with a dispenser head, wherein the dispenser head has a dispensing mouth and the dispenser head can be pressed down against a stop in the direction of a vertical axis of the dispenser to perform a pumping operation, wherein the stop is adjustable in terms of its height.

For example, dispensers of the kind in question are used for dispensing portions of creams, for example, and further care cream or toothpaste, for example, or for dispensing lotions, for example, wherein a follow-up piston can be provided in a container that stocks the compound, and the compound can be dispensed in portions by the pumping motion of the dispenser head.

PRIOR ART

In particular for variably adjusting a quantity of the compound dispensed by a pumping motion, it is known to impart an adjustable design to the stop against which the dispenser head drives while being pressed down during a pumping motion. For example, such a dispenser is known from DE 94 19 268 U1 (WO 96/16746 A1), wherein the dispenser has an activating ring accessible to the user from outside for adjusting the stop height.

Known from US 2011/0289890 A1 is an aerosol dispenser, in which a downward pressing motion of the nozzle head can be limited by a rotatable sliding track. Such an aerosol dispenser is also known from U.S. Pat. No. 5,363,992 A. The nozzle head can assume only two singular positions in which either one or the other spray head is active.

Known from WO 201 6/1 761 56 Al is a dispenser in which the dispenser head can be rotated relative to a fixed sliding track. The sliding track has a stepped design.

Known from JP 2004-099061 A is a dispenser in which a locking part can be clipped onto a neck of the dispenser head. The locking part can consist of a wedged or wedge-stepped surface.

SUMMARY OF THE INVENTION

Proceeding from the last mentioned prior art, the invention deals with the task of indicating a dispenser which is advantageous in terms of handling.

This task is resolved for a dispenser, wherein the emphasis is placed on the dispenser head being movable solely by turning the sliding track in the direction of the vertical axis for resetting purposes, and on the sliding track being designed like a helical surface.

The interaction between the dispenser head and the stop is correspondingly provided by a projection on the dispenser head side and a sliding track that can rotate around the vertical axis relative to the dispenser head. In particular the sliding track, but preferably beyond that the projection as well, preferably are outwardly exposed, and are thus further preferably visible to the user. This embodiment gives the user a direct visual feedback, in particular via the free stroke path of the dispenser head that arises by adjusting the sliding track.

The dispenser head can here be relocated in the direction of the vertical axis limited by a stop both while pressing down and during a return movement. In another embodiment, the dispenser head can here be fixed in the peripheral direction relative to the sliding track that can be rotated around the vertical axis.

In one possible embodiment, the dispensing opening of the dispenser head can be directed toward the top, if necessary centrally receiving the longitudinal axis, during a normal handling of the dispenser where the dispenser longitudinal axis is vertically aligned. In this case, the projection of the dispenser head that interacts with the sliding track can be a massive section of the dispenser head, for example.

Alternatively, as further also preferred, the projection can simultaneously have the dispensing opening. Accordingly, the projection is provided at least with a section of a dispensing channel that empties into the dispensing opening on the end side. In a possible embodiment, the dispensing channel wall is thereby advantageously simultaneously used as a projection for individually adjusting the compound volume that can be dispensed.

The dispenser head can only be moved via a downward pressing motion by the user and rotation of the sliding track in the direction of the vertical axis. This embodiment makes it possible to indicate a dispenser without an elastic resetting device, in particular a spring. The respective relocation of the dispenser head is preferably made possible only by a willful intervention by the user. In this way, the dispenser head can stay in the pressed down position even under no load.

A portioned compound is dispensed in the usual manner by pressing down the dispenser head along the vertical axis until reaching the stop position. The dispenser head can be reset, and thus a pump chamber can concurrently preferably be refilled, solely by turning the sliding track. By turning the sliding track during an interaction with the projection lying on the sliding track, the rotational motion is converted into a linear motion to reset the dispenser head.

The sliding track is designed like a helical surface. This helical surface rises in the peripheral direction of the sliding track in the direction toward the vertical axis, so that a plane viewed transverse to the vertical axis, which intersects the helical surface at a peripheral end point, is spaced apart in an axial direction from an additional plane likewise aligned transverse to the vertical axis, which intersects the helical surface in a point remote from the end point in the peripheral direction, possibly a starting point.

The resultant gradient of the helical surface can be uniform over the length of the helical surface in the peripheral direction. Alternatively, however, a nonuniform, possibly even approximately gradual, progression of the helical surface is also possible in this regard.

The helical surface can possibly extend over the entire periphery of the sliding track. Preferred in this regard is an arrangement of two or more helical surfaces lying one after the other in the peripheral direction. The latter can each extend in equal or unequal sectional lengths.

Another preferred embodiment can thus provide that the two or more, up to ten or twenty, helical surfaces be uniformly offset relative to each other in the peripheral direction. In this regard, equal helical surfaces can form. Helical surfaces with varying gradients or gradient progressions are also possible. The arrangement of two, three or four helical surfaces can preferably be provided, possibly up to eight or twelve or more.

Given a corresponding rotational motion of the sliding track, the interaction between the projection and helical surface allows the dispenser head to relocate from a lowermost position possibly limited by a stop back along the vertical axis and into the starting position or pump chamber filling position. In an exemplary arrangement of two helical surfaces and an extension of a helical surface by an exemplary 180°, this basic dispenser position, from which a renewed dispensing of compound can take place, can be reached after the sliding track has been rotationally relocated by a maximum of 180°.

A vertical stage can be formed between the helical surfaces in the peripheral direction. This vertical stage can connect a high plane that is defined by the respective helical surface and runs perpendicular to the vertical axis with a respective low plane of the helical surface that follows in the peripheral direction. This vertical stage can here have a vertical surface, which connects these planes and can essentially be radially aligned with respect to the vertical axis.

As the helical surface end arising in the peripheral direction spills over in the area of the high plane, the formation of the vertical stage shifts the projection into a rotational position, in which the projection is spaced apart in an axial direction from the next helical surface in the peripheral direction, so that the dispenser head can be pressed down out of this position in order to dispense compound.

In the basic position of the dispenser, if the projection is allocated to the deepest plane of the helical surface relative to a vertical projection, in which the axis is represented by a point, this preferably results in a maximum possible relocation path of the dispenser head in an axial direction, corresponding to a maximum dispensing of a compound portion. By contrast, if the sliding track continues to be rotationally relocated so as to diminish the vertical distance between the projection of the dispenser head and the helical surface bringing into correspondence with the projection, this yields a corresponding reduction in the free vertical relocatability of the dispenser head, and hence a reduction in the dispensing volume per dispensing operation.

In a possible embodiment, the helical surface can comprise part of the end face of the dispenser in a vertical projection, in which the vertical axis appears in the form of points. In one possible formation of two helical surfaces provided one after the other in a peripheral direction, these can annularly envelop the activatable dispenser head as a whole, wherein the helical surfaces that interact with the projection, possibly with the exception of the area covered by the projection, can be vertically exposed toward the top in design.

In another possible embodiment, two or more uniformly peripherally offset projections can be formed on the dispenser head. In one possible embodiment of helical surfaces that are unform in the peripheral direction, a respective projection can interact with a helical surface, preferably in such a way that a tilt-free vertical relocation of the dispenser head, in particular from the pressed down position back into the basic position of the dispenser, can be achieved through this interaction.

The sliding track can be designed to completely envelop the dispenser head in the vertical projection, with the exception of the projection having the dispensing opening and/or the additional projection of the dispenser head. Accordingly, the sliding track can be at least almost completely visually exposed for the user as viewed from the top, and further preferably also as viewed from the side, in which case the vertical axis resembles a line.

A transport lock or the like can also be achieved by rotationally relocating the sliding track into a position in which the projection is moved in the area of a high plane of the helical surface, possibly in the rotational direction before reaching the vertical stage. In this maximum, relocated dispenser basic position of the dispenser head, the latter cannot be relocated vertically downward to dispense compound, because the projection is supported on the helical surface.

A rotational direction of the sliding track can also be prescribed by a locking mechanism. For example, a so-called ratchet mechanism can further be provided, which only allows the sliding track to rotate in the rotational direction that enables a lifting of the projection via the helical surface and the dispenser head via the projection along the vertical axis. The sliding track can be impeded from rotating in the opposite direction.

In addition, one possible embodiment can provide a rotational stop for the sliding track. The rotational stop enables a defined end rotational position of the sliding track, and by way of the latter a corresponding end relocation position of the dispenser head in a vertically upward relocation direction. For example, the rotational stop can be configured in such a way that the maximum stroke of the dispenser head is achievable in the end position limited by a stop. For example, given two equal helical surfaces offset by 180°, two rotational stops likewise offset by 180° in the peripheral direction can be provided.

BRIEF DESCRIPTION OF THE DRAWINGS

The invention is described in greater detail below based on the attached drawing, which only shows an exemplary embodiment. Shown on.

DESCRIPTION OF THE EMBODIMENTS

Figure 1:
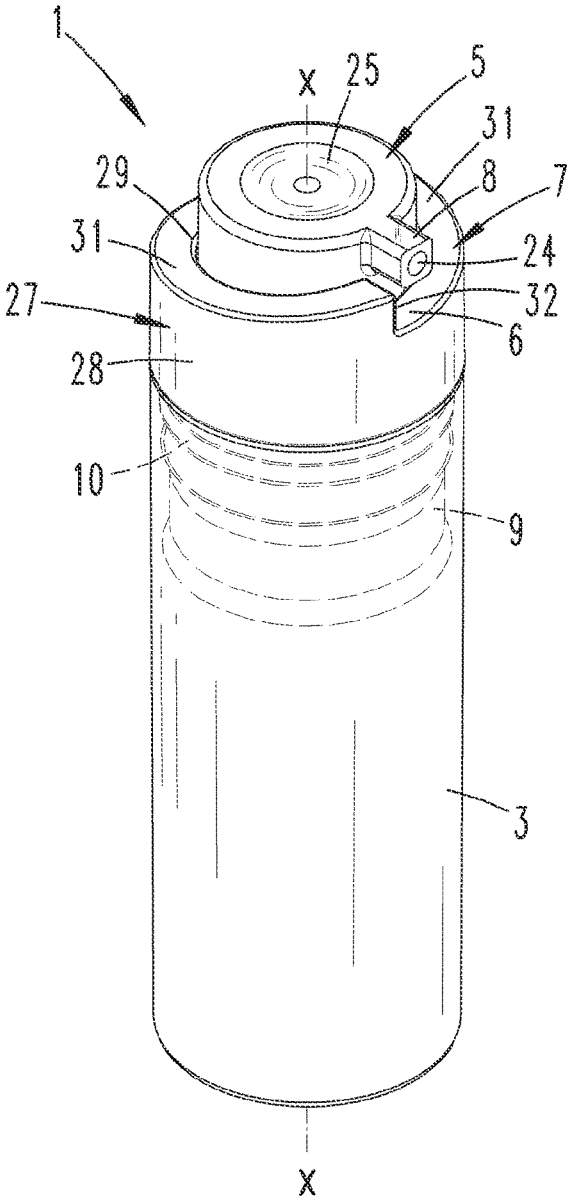
FIG. 1 is a perspective view of a dispenser of the kind in question, relating to a basic dispenser position.
Figure 2:
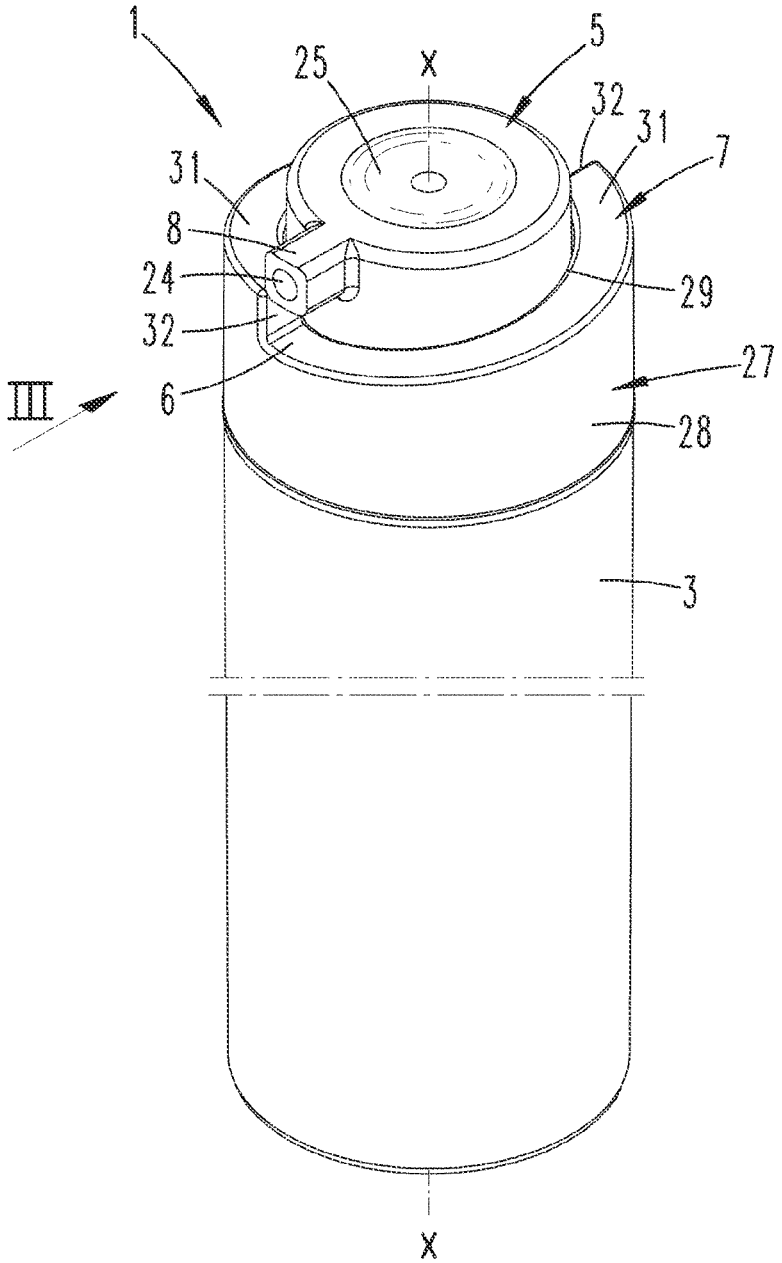
FIG. 2 is a perspective view of the area of the dispenser head of the dispenser, the view being magnified in relation to FIG. 1, relating to the basic position according to FIG. 1.
Figure 3:
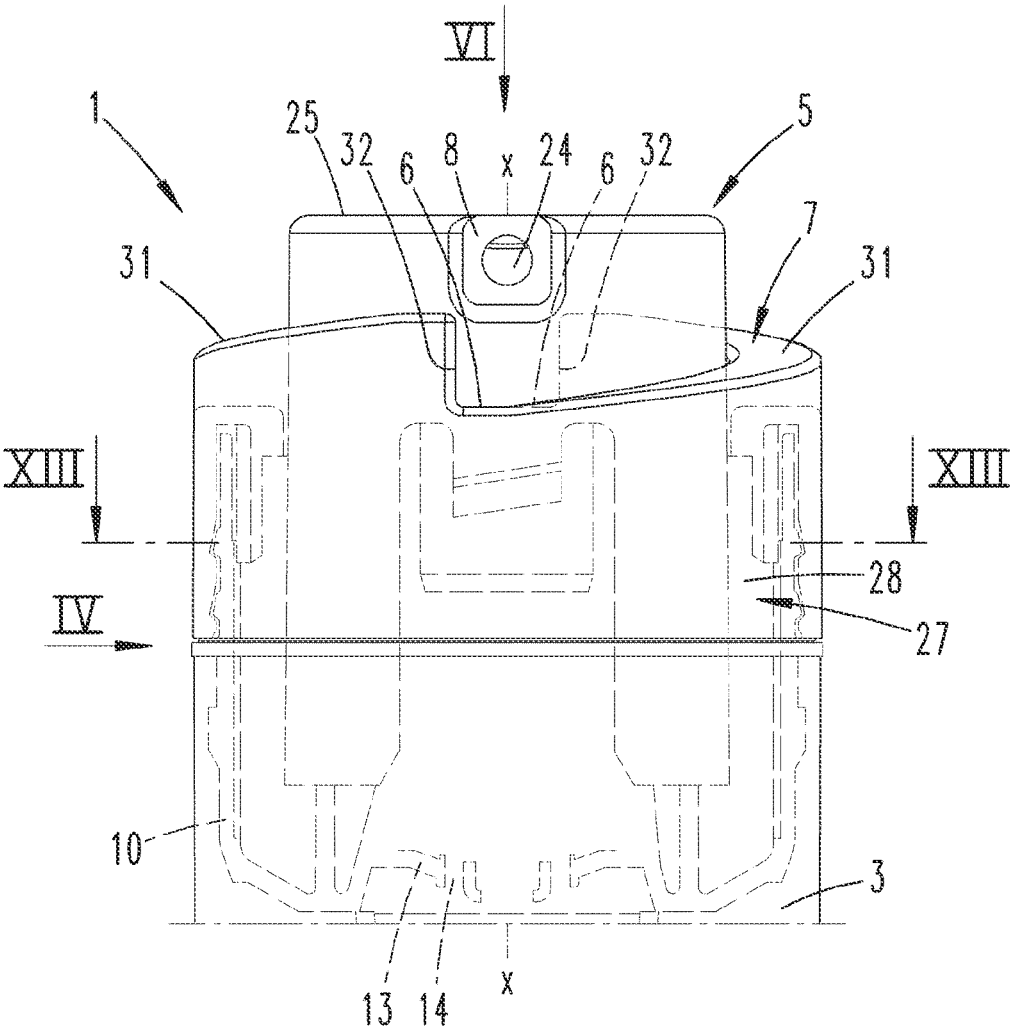
FIG. 3 is the view against the dispenser according to arrow III on FIG. 2.
Figure 9:
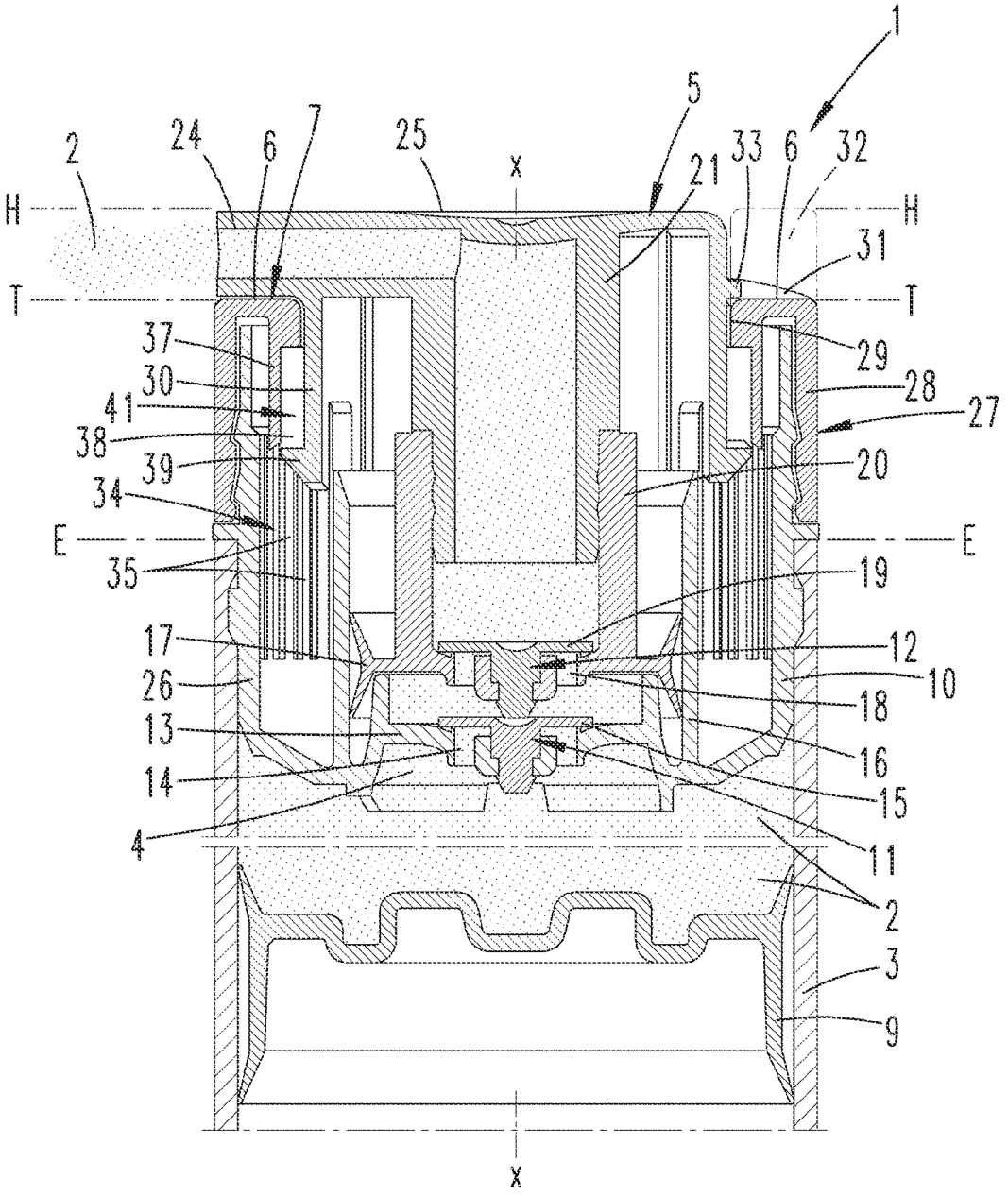
FIG. 9 is the section according to sectional plane IX on FIG. 8.

Depicted and described, initially with reference to FIG. 1 and the vertical sectional view on FIG. 9, is a dispenser 1 for dispensing flowable, for example liquid to pasty, compounds 2.

The dispenser 1 can have a storage tank 3 for the compound 2, and a pump chamber 4, and further a dispenser head 5. It can be possible to press the dispenser head 5 down against a stop 6 in the direction of a vertical axis x of the dispenser 1 to perform a pumping operation, wherein the stop 6 can essentially be formed by a sliding track 7 that can be rotated around the vertical axis x, against which a projection 8 that protrudes radially outward on the dispenser head 5 can come to a stop.

The dispenser head 5 is preferably coupled to a storage tank 3, for example screwed or latched thereto.

The molded parts of the dispenser 1 can consist predominantly of a plastic material, for example polyethylene, and are preferably manufactured in an injection molding process. In any case, significant exceptions in the depicted exemplary embodiment are those valves comprised of a rubbery material, which can be a TPE (and in this regard can also find application in the injection molding process), but in the exemplary embodiment is preferably vulcanized.

A castor piston 9 can be positioned in the storage tank 3, and used to transport the compound 2 to be dispensed in the direction toward the dispenser head 5.

The dispenser 1 can further essentially consist of a pot-shaped lower part 10, which forms a partition wall for the storage tank 3, the pump chamber 4 with an inlet valve 11 and an outlet valve 12 and the dispenser head 5.

The dispenser components can be arranged essentially rotationally symmetrical to the vertical axis x, wherein the vertical axis x can simultaneously comprise the body axis of the storage tank 3.

The pot floor 13 of the lower part 10 can have a central opening 14. The latter is preferably covered by a flexible shuttering plate 15 that forms the inlet valve 11.

A cylinder wall 16 can grow out of the pot floor 13 radially outside of the inlet valve 11 to envelop the pump chamber 4. A pump piston 17 is preferably held in this pump chamber 4 so as to be movable in the axial direction. Through openings 18 can be centrally provided in the pump piston 17, which together with an additional, flexible shuttering plate 19 that covers the latter on the side facing away from the inlet valve comprise the outlet valve 12.

The outlet valve 12 can be enclosed by a hollow cylindrical pump piston part 20 that forms a neck, and can form the attachment to the dispenser head 5.

The dispenser head 5 can engage into the pump piston part 20 with a central, cylindrical hollow body 21. The dispenser head 5 and pump piston 17 can be latched with each other in this overlap area.

The hollow body 21 can form a dispensing channel 23. The latter can initially proceed from the end of the hollow body 21 facing the outlet valve 12 and run in an axial extension, and finally transition into a laterally tapering area, which has a dispensing area 24 formed at its end. This area of the dispensing channel 23 can be arranged directly underneath an activating surface 25 of the dispenser head 5 that essentially runs roughly perpendicular to the vertical axis x.

Given a pot opening that faces vertically upward, the lower part 10 with a pot-shaped design can have a pot wall 26 with a radially outward periphery, which serves to secure the dispenser 1 to the storage tank 3 in the area of the tank opening. This can be a latching attachment, as also depicted.

The pot wall 26 can preferably freely extend vertically upwardly over the opening plane E of the storage tank 3 so as to provide an attachment collar for the rotating part 27.

The rotating part 27 can encompass the pot wall 26, and is rotatable around the vertical axis relative to the pot wall 26, but mounted to the pot wall 26 so that it cannot be relocated in the axial direction.

As also depicted, the external shell surface of the rotating part 27 can be provided as an elongation of the shell surface of the storage tank 3.

The outer peripheral wall 28 of the rotating part 27 can transition into a radially inwardly protruding cover, which essentially extends in a plane perpendicular to the vertical axis x, and can essentially be formed by the sliding track 7.

The cover of the rotating part 27 formed in this way is preferably centrally penetrated to form an opening 29, through which a vertically downwardly protruding collar formed on the dispenser head 5 can plunge into the dispenser interior. The outer diameter of the collar 30 can be adjusted to the inner diameter of the opening 29, so that the rotating part 27 can possibly be rotationally guided in this way as well.

The sliding track 7 can essentially be composed of two helical surfaces 31 that successively follow each other in the peripheral direction. Each helical surface 31 preferably extends in the peripheral direction by 180°, wherein a respective vertical stage 32 can be formed in the peripheral direction between the helical surface 31.

As also depicted, each helical surface 31 can proceed from a low plane T aligned perpendicular to the vertical axis x toward a high plane H that is spaced apart in the axial direction and likewise runs perpendicular to the vertical axis x, and preferably rise continuously at a constant gradient (see also FIGS. 2 to 7).

Figure 4:
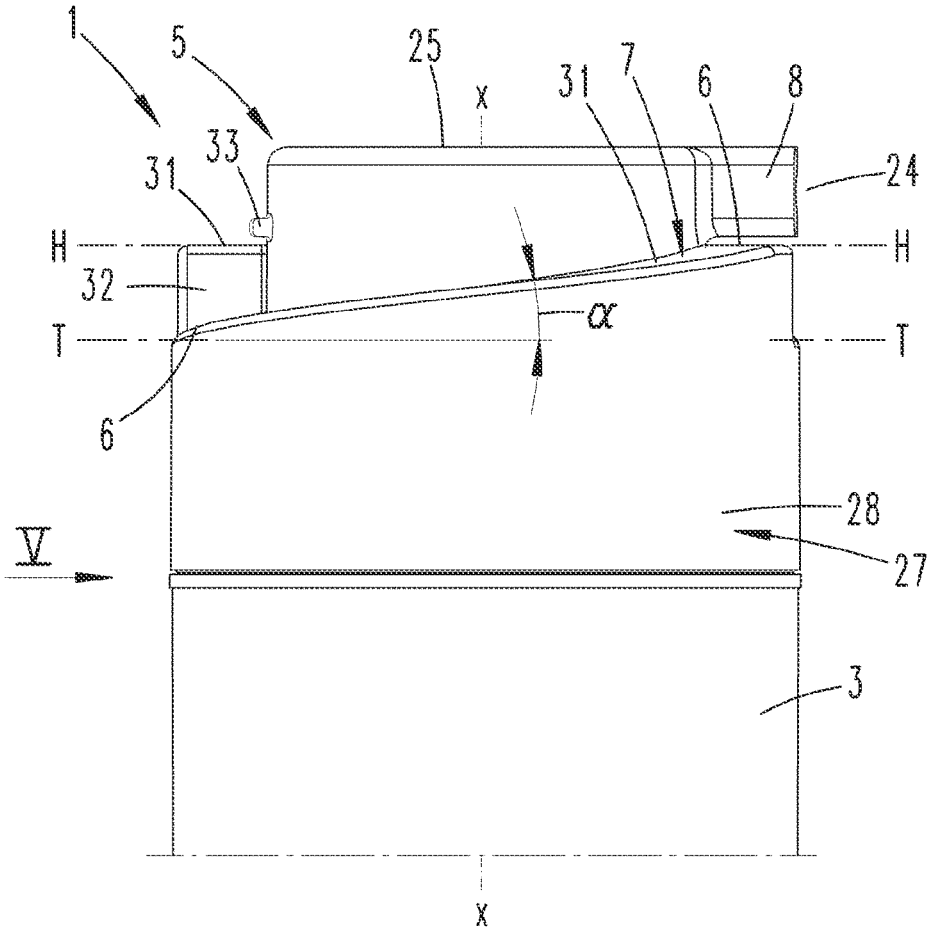
FIG. 4 is the view according to arrow IV on FIG. 3.

The gradient angle can measure about 10° to 20°, further for example about 15°, wherein there can further be a rise in the respective helical surface 31 in the counterclockwise direction in the exemplary embodiment shown with reference to the graphic depictions (for example with reference to FIG. 4).

The distance dimension a viewed in the axial direction between the low plane T and the high plane H can correspond to the maximum pump relocation path of the dispenser head 5 in an axial direction for dispensing compound 2.

By twisting the rotating part 27 around the vertical axis x, and thus by concurrently relocating the helical surfaces 31 that form the stop 6 for the projection 8 relative to the projection 8 that is fixed by comparison, a change can be made in the distance dimension a, so that an adjustment of the maximum low pressure dimension of the dispenser head 5 can correspondingly also be achieved out of the basic dispenser position according to FIG. 1 by turning the rotating part 27.

The downward pressing motion of the dispenser head 5 for dispensing compound preferably takes place without overcoming a resetting force of a spring or the like. Instead, the downward pressing motion of the dispenser head 5 along the vertical axis x takes place solely against the resistance of the compound 2 in the pump chamber 4, which is dispensed during the downward pressing motion via the outlet valve 12 and the dispensing channel 23.

This downward pressing motion enables a rotational position of the rotating part 27 in which the projection 8, which initially and essentially is formed by the wall of the dispensing channel 23 with the dispensing opening 24, is spaced apart from the allocated helical surface 31 in the downward pressing direction, i.e., vertically downward with reference to the drawings.

An alignment of the projection 8 as viewed in the peripheral direction is here preferably approximately directly adjacent to a vertical stage 32. This results in a possible maximum vertical relocation of the dispenser head 5, since the maximum distance dimension a arises in this area adjacent to the vertical stage 32 (see also FIG. 8).

Figure 8:
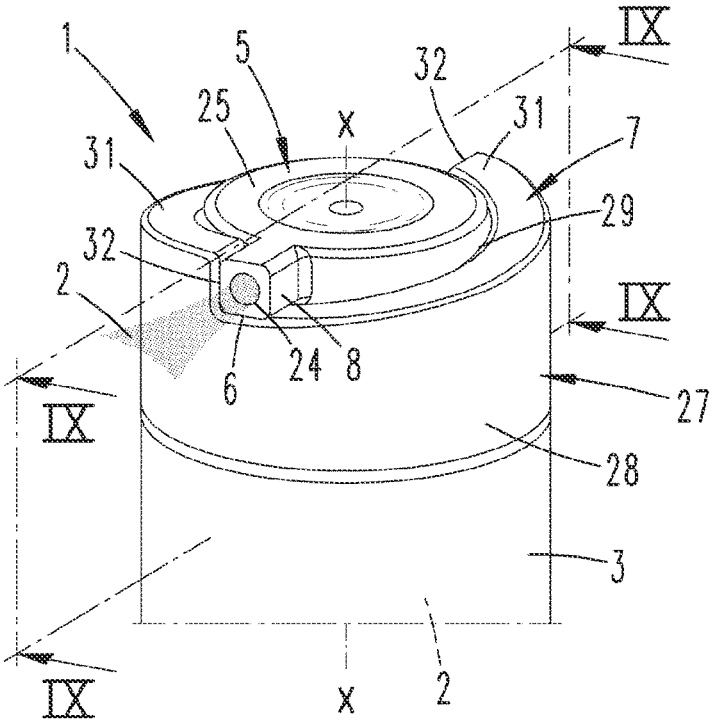
FIG. 8 is a view essentially corresponding to FIG. 2, but relating to a compound dispensing position.
Figure 11:
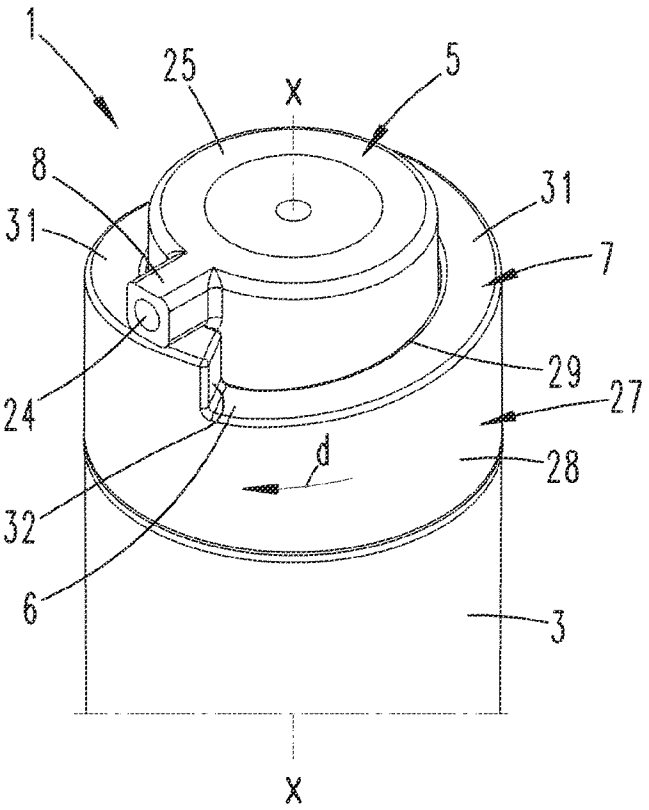
FIG. 11 is another follow-up view to FIG. 10, relating to an intermediate position shortly before reaching the basic dispenser position.
Figure 10:
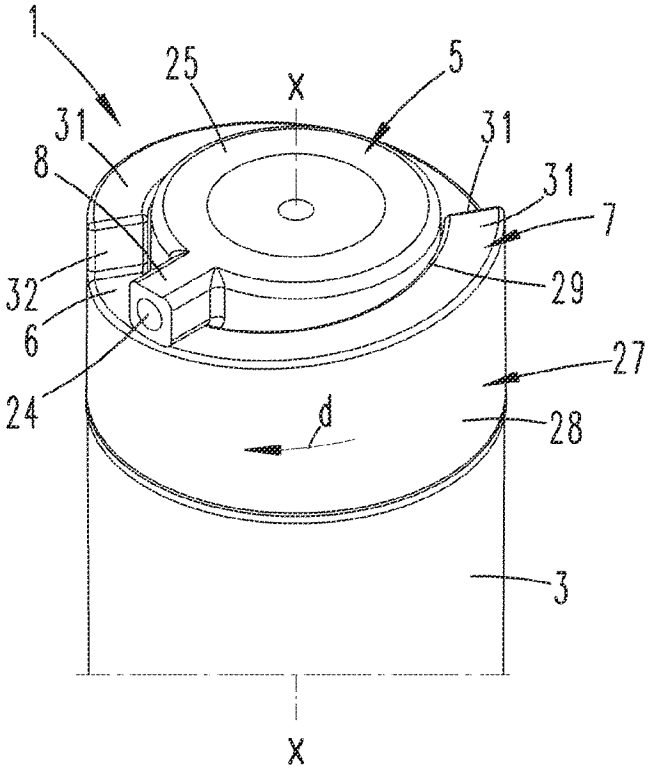
FIG. 10 is another view corresponding to FIG. 2, relating to an intermediate position during a relocation of the dispenser head back in the direction toward the basic dispenser position by rotating a sliding track.
Figure 12:
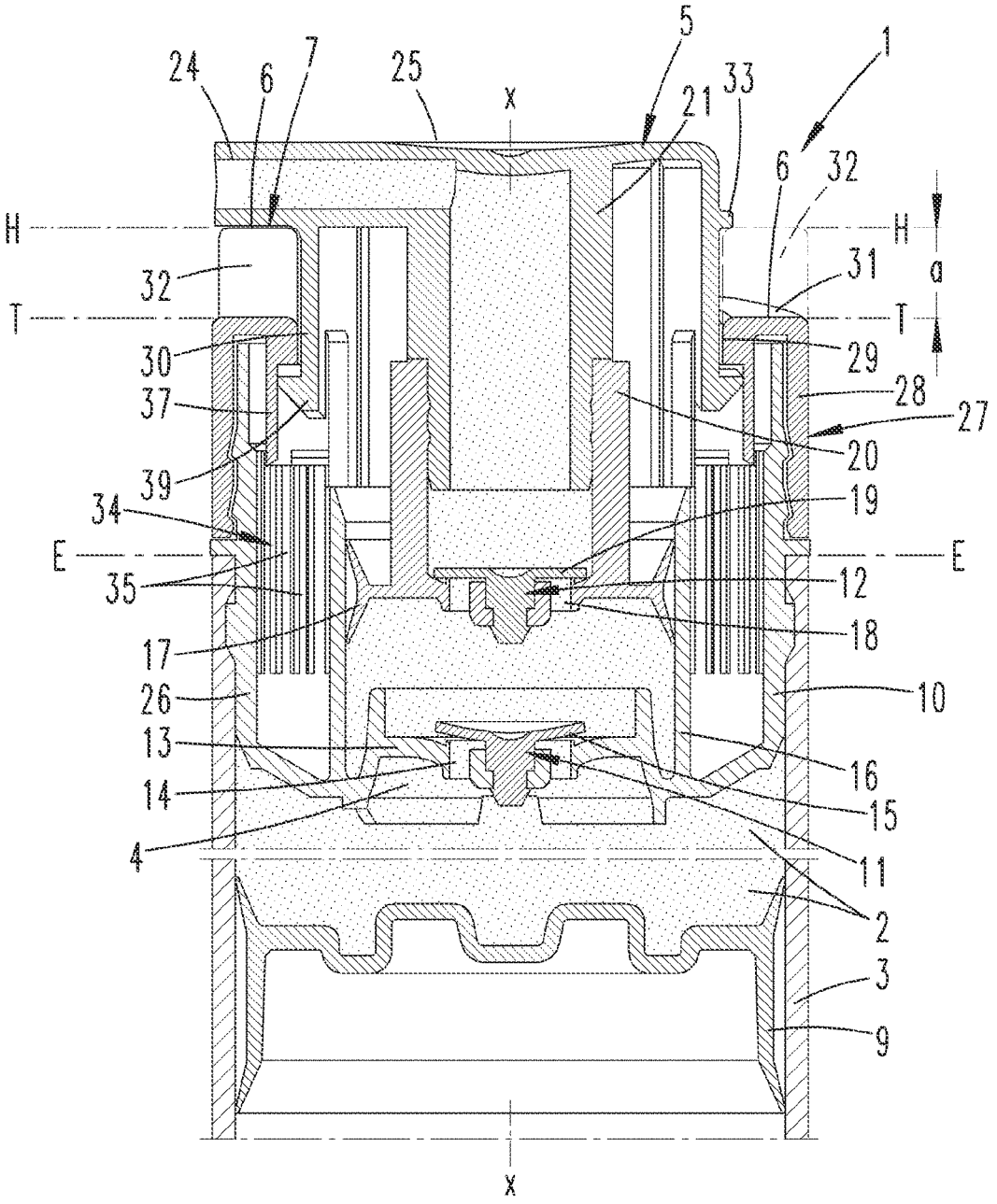
FIG. 12 is a sectional view according to FIG. 9, but relating to the basic dispenser position reached by rotating the sliding track.

The downward pressure position that dispenses the compound 2 as depicted on FIGS. 8 and 9 makes it possible to vertically move the dispenser head 5 back into its basic dispenser position according to FIG. 1, preferably solely by rotating the rotating part 27, wherein the projection 8 resting on the helical surface 31 glides along the helical surface 31 during this rotation (see FIGS. 10 and 11), as a result of which the rising helical surface 31 converts the rotational motion of the rotating part 27 into a vertical motion of the dispenser head 5 that is impeded from rotating in the peripheral direction, until the latter again reaches the basic dispenser position according to FIG. 12.

Figure 6:
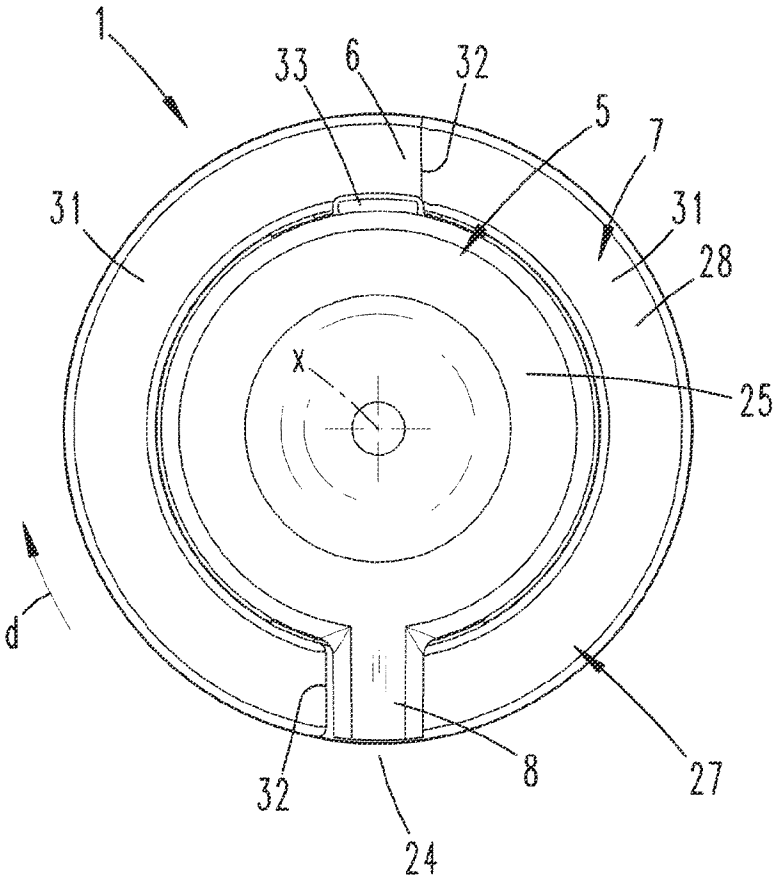
FIG. 6 is the top view of the dispenser according to arrow VI on FIG. 3.
Figure 5:
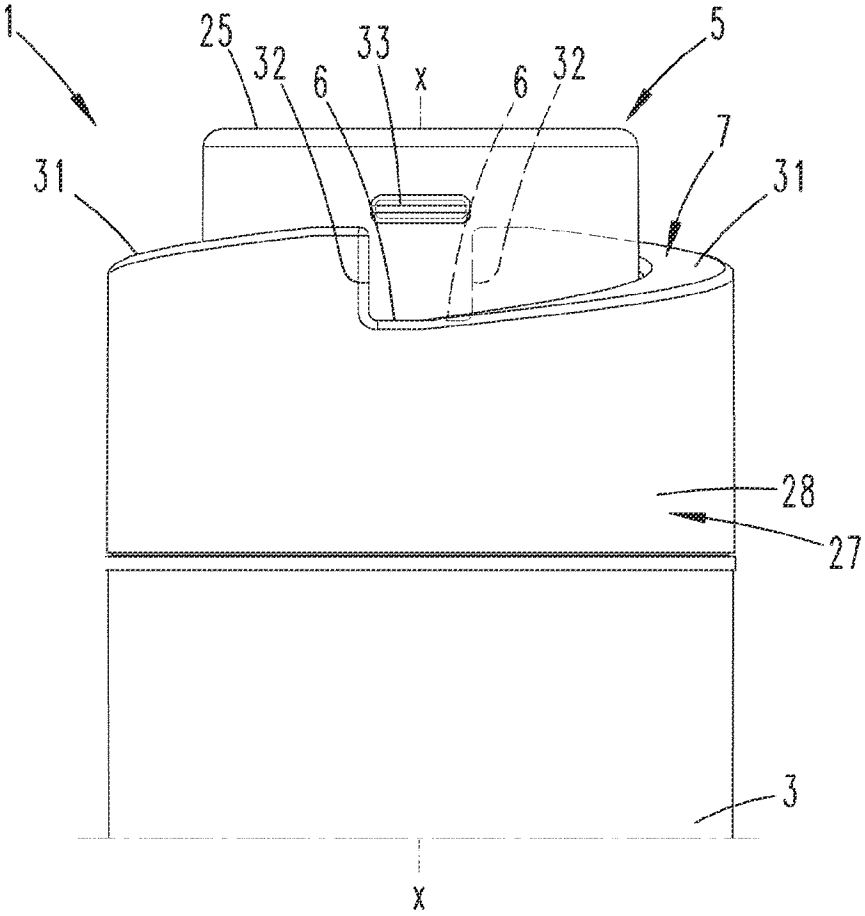
FIG. 5 is the rear view against the dispenser according to arrow V on FIG. 4.
Figure 7:
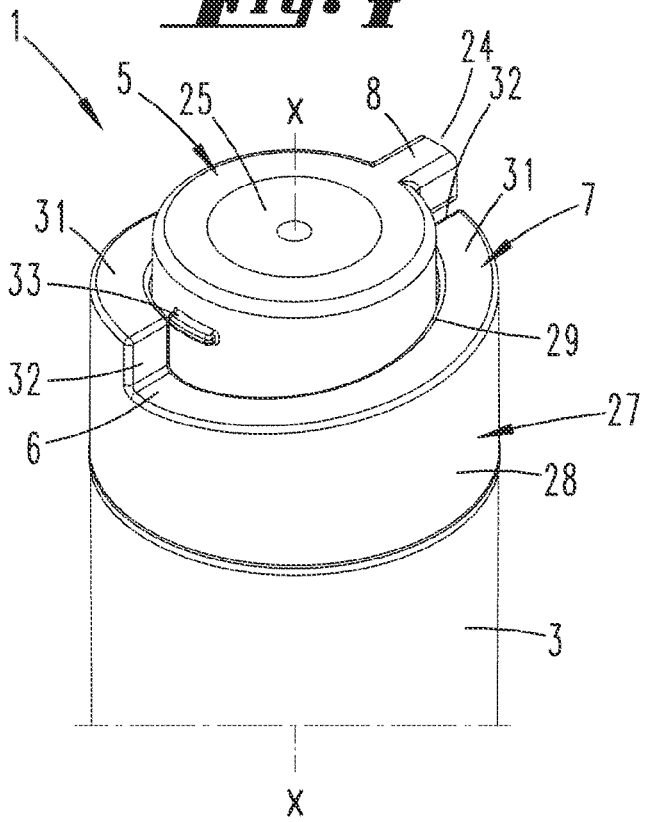
FIG. 7 is another perspective view of the dispenser in the basic position, relating to a rear view according to FIG. 5.

As also depicted, it is further preferred with reference to a top view according to FIG. 6 that another projection 33 be provided diametrically opposite the projection 8 created by the dispensing channel wall, which rests on the helical surface 31 not utilized by the projection 8, and in particular supports the vertical motion of the dispensing head 5 while rotating the rotating part 27.

The subsurface of the projection 8 and/or 33 that faces the helical surface 31 can be adjusted at a slant to the gradient of the helical surface 31 so as to abut at least approximately the entire surface.

As evident in particular from the illustration on FIG. 6, the sliding track 7 formed by the helical surfaces 31 arranged one after the other in the peripheral direction can be arranged and designed so as to essentially completely envelop the dispensing head 5, except for the projection 8 that has the dispensing opening 24 and/or the additional projection 33 of the dispensing head 5, so that the sliding track 7 or the helical surfaces 31 can essentially form the end face of the dispenser 1 together with the dispenser head 5.

The dispenser 1 can further have a locking mechanism 34 to prescribe a rotational direction d. In the exemplary embodiment shown, the latter is configured in such a way as to only allow a clockwise rotational direction d in reference to a top view according to FIG. 6.

Figure 13:
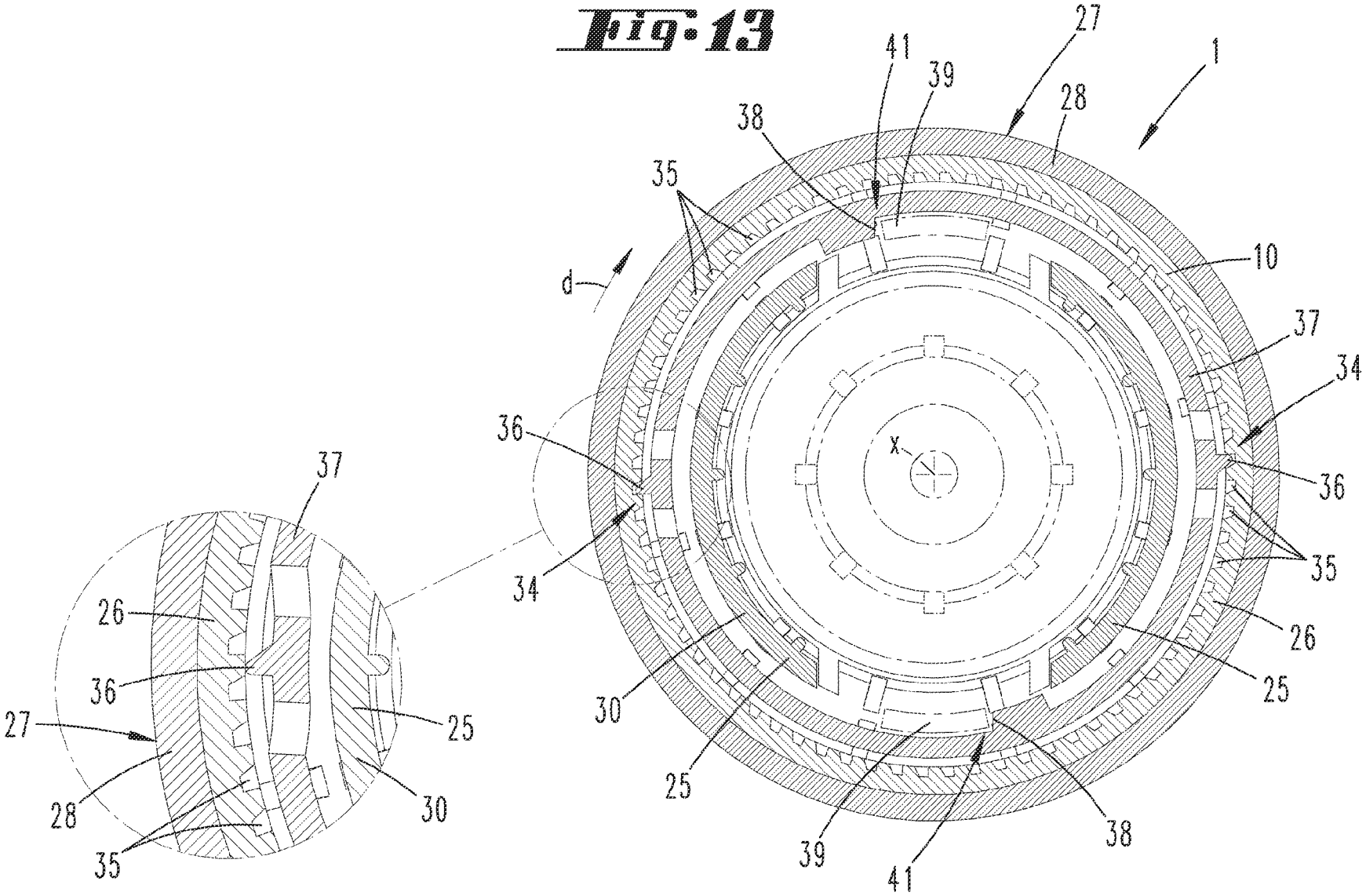
FIG. 13 is the section according to line XIII-XIII on FIG. 3.
Figure 14:
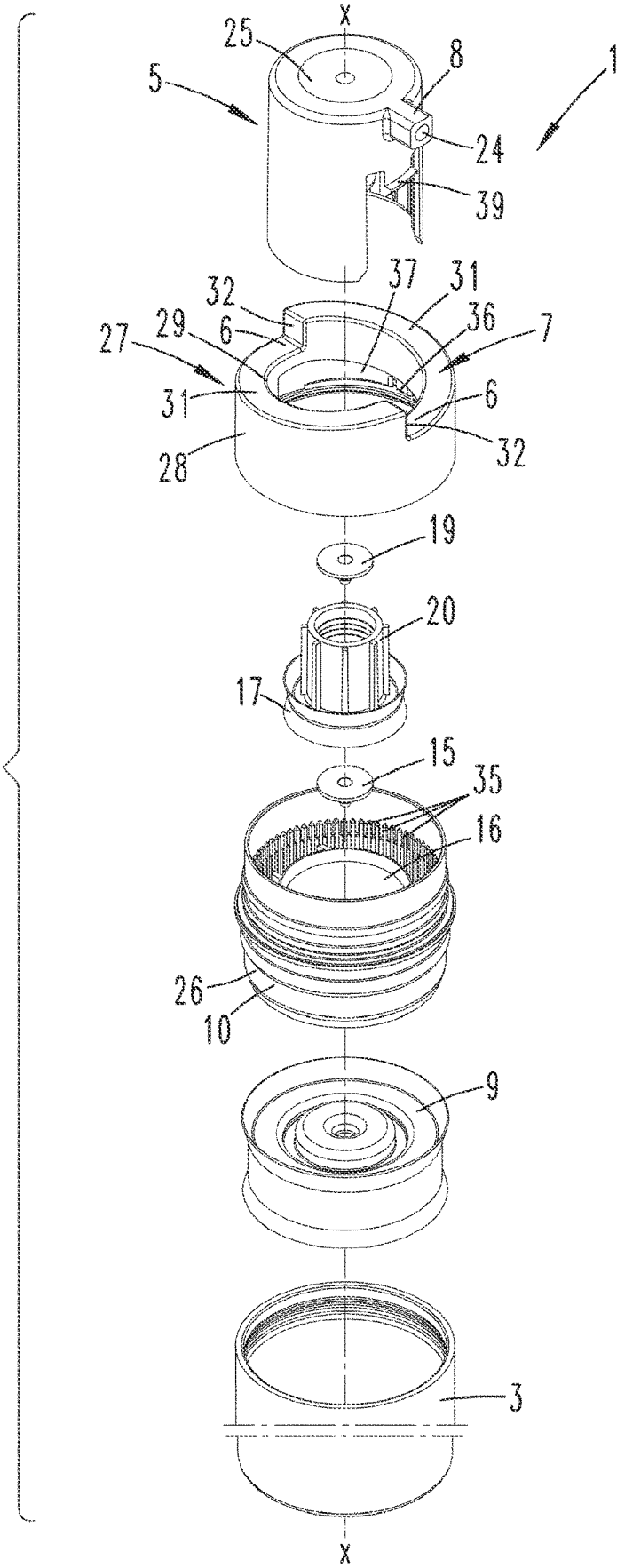
FIG. 14 is a perspective, exploded view of the individual parts of the dispenser.

The locking mechanism 34 can be designed like a kind of latching mechanism, for which purpose one possible embodiment can provide latching grooves 34 uniformly distributed in the peripheral direction on the inside of the top wall 26 of the lower part 10, which can be traversed by a latching projection 36 that engages into a respective latching groove 35 in only one rotational direction, specifically in rotational direction d (see in particular FIG. 13).

The exemplary embodiment shown provides two latching projections 36, which with reference to a cross sectional view according to FIG. 13 can be arranged diametrically opposite each other.

Both latching projections 36 can preferably be arranged so as to spring out radially inwardly (see enlarged magnifier view on FIG. 13).

Figure 15:
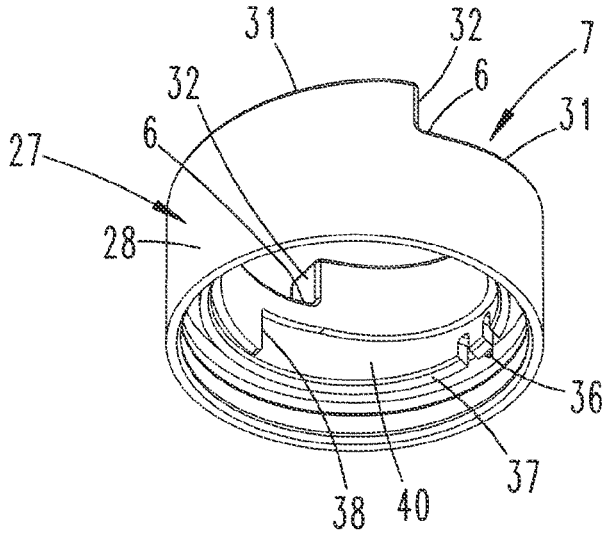
FIG. 15 is a perspective, individual view of a rotating part that has the sliding track.

The latching projections can be molded onto a radially inner retaining wall 37 formed coaxially to the wall 28 of the rotating part 27, or cut out of this retaining wall 37 (see also FIG. 15).

The latching grooves 35 can be distributed over the periphery in such a way that an acute angle of about 5° to 10° can be included between two latching grooves 35 adjacent in the peripheral direction.

A rotating stop limit can furthermore also be provided, which during a corresponding activation prevents the rotating part 27 from being further relocated, for example beyond a 180° position.

Locking shoulders 38 that are aligned essentially axially parallel diametrically opposite each other with reference to a cross section perpendicular to the vertical axis x can be formed on the inside of the wall, i.e., radially inside of the retaining wall 37 of the rotating part 27.

The collar 30 of the dispenser head 5 can carry radially outwardly protruding locking projections 39 on diametrically opposing sections, which can come to abut the allocated locking shoulders 38 in the basic dispenser position according to FIG. 1.

The locking projections 39 can be relocated into an axial position only with the dispenser head in the pressed down position, for example according to FIG. 9, in which they do not block the rotating path of the locking shoulder 38. As the rotating part 27 rotates, the locking projections 39 first run under the locking shoulders 38. The retaining wall 37 is correspondingly provided with a groove-like recess 40 to allow an axial relocation of the dispenser head 5, and thus also of the locking projections 39, axially toward the top.

During the rotational motion of the rotating part 27, the locking projection 39 can emerge through this recess 40 in an axial direction until reaching a position in which the locking shoulder 38 of the rotating part 27 hits the locking projection 39 in a locking manner. In particular the projection 8 that has the dispensing opening 24, and further also the possibly provided projection 33, is exposed in this position for activating the pump.

The above statements serve to explain the inventions covered by the application as a whole, which each also independently advance the prior art at least by the following feature combinations, wherein two, several or all of these feature combinations can also be combined, specifically:

A dispenser 1 for dispensing flowable, for example liquid or pasty, compounds 2, with a storage tank 3 for the compound 2 and a pump chamber 4, further with a dispenser head 5, wherein the dispenser head 5 has a dispensing mouth 24 and the dispenser head 5 can be pressed down against a stop 6 in the direction of a vertical axis x of the dispenser 1 to perform a pumping operation, wherein the stop 6 is adjustable in terms of its height, characterized in that the stop 6 is formed by an outwardly exposed sliding track 7 that can be rotated around the vertical axis x, against which a projection 8 that protrudes radially outward on the dispenser head 5 comes to a stop when pressing down.

A dispenser 1, characterized in that the projection 8 has the dispensing opening 24.

A dispenser 1, characterized in that the dispenser head 5 can only be moved by a downward pressing motion of the user and/or rotating the sliding track 7 in the direction of the vertical axis x.

A dispenser 1, characterized in that the sliding track 7 is designed like a helical surface 31.

A dispenser 1, characterized in that the helical surface 31 extends free of steps over practically an entire periphery of the helical surface 31.

A dispenser 1, characterized in that two or more helical surfaces 31 lying one after the other are formed in the peripheral direction.

A dispenser 1, characterized in that the two or more helical surfaces 31 are offset uniformly to each other in the peripheral direction.

A dispenser 1, characterized in that a vertical stage 32 is formed between the helical surfaces 31 in the peripheral direction.

A dispenser 1, characterized in that the helical surface 31 forms part of the end face of the dispenser 1 in a vertical projection, in which the vertical axis x is represented by a point.

A dispenser 1, characterized in that two or more uniformly peripherally offset projections 8, 33 are formed on the dispenser head 5.

A dispenser 1, characterized in that the sliding track 7 is designed to completely envelop the dispenser head 5 in the vertical projection, with the exception of the projection 8 having the dispensing opening 24 and/or the additional projections 33 of the dispenser head 5.

A dispenser 1, characterized in that a rotational direction d of the sliding track 7 is prescribed by a locking mechanism 34.

A dispenser 1, characterized in that a rotational stop 41 is provided for the sliding track 7.

All disclosed features (whether taken separately or in combination with each other) are essential to the invention. The disclosure of the application hereby also incorporates the disclosure content of the accompanying/attached priority documents (copy of the prior application) in its entirety, also for the purpose of including features of these documents in claims of the present application. Even without the features of a referenced claim, the subclaims characterize standalone inventive further developments of prior art with their features, in particular so as to submit partial applications based upon these claims. The invention indicated in each claim can additionally have one or several of the features indicated in the above description, in particular those provided with reference numbers and/or indicated on the reference list. The invention also relates to design forms in which individual features specified in the above description are not realized, in particular if they are recognizably superfluous with regard to the respective intended use, or can be replaced by other technically equivalent means.

| REFERENCE LIST | |
|---|---|
| 1 | Dispenser |
| 2 | Compound |
| 3 | Storage tank |
| 4 | Pump chamber |
| 5 | Dispenser head |
| 6 | Stop |
| 7 | Sliding track |
| 8 | Projection |
| 9 | Follow-up piston |
| 10 | Lower part |

-continued

| REFERENCE LIST | |
|---|---|
| 11 | Inlet valve |
| 12 | Outlet valve |
| 13 | Pot floor |
| 14 | Opening |
| 15 | Shuttering plate |
| 16 | Cylinder wall |
| 17 | Pump piston |
| 18 | Through opening |
| 19 | Valve plate |
| 20 | Pump piston part |
| 21 | Hollow body |
| 22 | — |
| 23 | Dispensing channel |
| 24 | Dispensing opening |
| 25 | Activating surface |
| 26 | Pot wall |
| 27 | Rotating part |
| 28 | Wall |
| 29 | Opening |
| 30 | Collar |
| 31 | Helical surface |
| 32 | Vertical stage |
| 33 | Projection |
| 34 | Locking mechanism |
| 35 | Latching groove |
| 36 | Latching projection |
| 37 | Retaining wall |
| 38 | Locking shoulder |
| 39 | Locking projection |
| 40 | Recess |
| 41 | Rotational stop |
| a | Distance dimension |
| d | Rotational direction |
| x | Vertical axis |
| E | Opening plane |
| H | High plane |
| T | Low plane |
| α | Angle |

The invention claimed is:

1. A dispenser for dispensing a flowable compound, comprising:

a storage tank for the compound, a pump chamber, and a dispenser head, wherein the dispenser head has a dispensing mouth and the dispenser head is configured to be pressed down against a stop in a direction of a vertical axis of the dispenser to perform a pumping operation, wherein the stop is adjustable in terms of its height, wherein the stop is formed by an outwardly exposed sliding track that is configured to be rotated around the vertical axis, against which a projection that protrudes radially outward on the dispenser head comes to a stop when pressing down, wherein the dispenser head is movable solely by turning the sliding track in the direction of the vertical axis for resetting purposes, and wherein the sliding track is designed as a helical surface.

2. The dispenser according to claim 1, wherein the projection has a dispensing opening.

3. The dispenser according to claim 1, wherein the helical surface extends free of steps over practically an entire length of the helical surface.

4. The dispenser according to claim 1, wherein the sliding track is formed by two or more helical surfaces lying one after the other in a peripheral direction relative to the vertical axis.

5. The dispenser according to claim 4, wherein the two or more helical surfaces are offset uniformly to each other in the peripheral direction.

6. The dispenser according to claim 4, wherein a vertical stage is formed between the helical surfaces in the peripheral direction.

7. The dispenser according to claim 1, wherein the helical surface forms part of an end face of the dispenser in a vertical projection, in which the vertical axis is represented by a point.

8. The dispenser according to claim 1, wherein two or more uniformly peripherally offset projections are formed on the dispenser head.

9. The dispenser according to claim 8, wherein the sliding track is designed to completely envelop the dispenser head in the vertical projection, with the exception of the additional projections of the dispenser head.

10. The dispenser according to claim 8, wherein one of the projections contains a dispensing opening, and wherein the sliding track is designed to completely envelop the dispenser head in the vertical projection, with the exception of the projection having the dispensing opening.

11. The dispenser according to claim 1, wherein a movement of the sliding track in a rotational direction is prescribed by a locking mechanism.

12. The dispenser according to claim 1, wherein a rotational stop is provided for the sliding track.

* * * * *